United States Patent [19]

Wild

[11] 4,057,864

[45] Nov. 15, 1977

[54] WET TRANSFER PRINTING PROCESS AND APPARATUS

[75] Inventor: Kenneth Wild, Middleton, England

[73] Assignee: Tootal Limited, Manchester, England

[21] Appl. No.: 591,152

[22] Filed: June 27, 1975

[30] Foreign Application Priority Data

July 9, 1974 United Kingdom ..... 30276/74
Apr. 28, 1975 United Kingdom ..... 17523/75

[51] Int. Cl.[2] ..... D06P 7/00

[52] U.S. Cl. ..... 8/2.5 R; 68/5 D; 101/472; 118/257

[58] Field of Search ..... 101/470, 472, 130, 132, 101/132.5; 118/257, 60, 202; 8/2.5 R, 148, 149.3; 38/44–46, 49, 54, 55, 101, 102; 68/5 D, 13 R, 22 R, DIG. 5; 156/235–238

[56] References Cited

U.S. PATENT DOCUMENTS

| | | | |
|---|---|---|---|
| 1,895,243 | 1/1933 | Dort | 8/2.5 X |
| 1,965,257 | 7/1934 | Paschel | 8/2.5 |
| 3,449,156 | 6/1969 | Brown | 68/22 R X |
| 3,469,932 | 9/1969 | Fleissner | 68/DIG. 5 |
| 3,768,280 | 10/1973 | Kannegiesser et al. | 118/257 X |
| 3,874,846 | 4/1975 | Ashe | 101/470 X |
| 3,905,765 | 9/1975 | Bissitt | 8/149.3 |

*Primary Examiner*—Edward M. Coven
*Assistant Examiner*—R. E. Suter
*Attorney, Agent, or Firm*—Cushman, Darby & Cushman

[57] ABSTRACT

The invention concerns a process for wet transfer printing and a machine for effecting this process. The machine includes a rotatable, heated cylinder around which a transfer web and a fabric web are continuously passed one on top of the other, the two webs being held together and in contact with the cylinder by means of a continuous belt which is guided around a portion of the cylinder with the two webs therebetween. The belt is made of a water impervious material and at least one pressure applicator is provided which is adapted to apply pressure, in addition to that provided by the belt, to the transfer/fabric web combination.

4 Claims, 3 Drawing Figures

—FIG. 1—

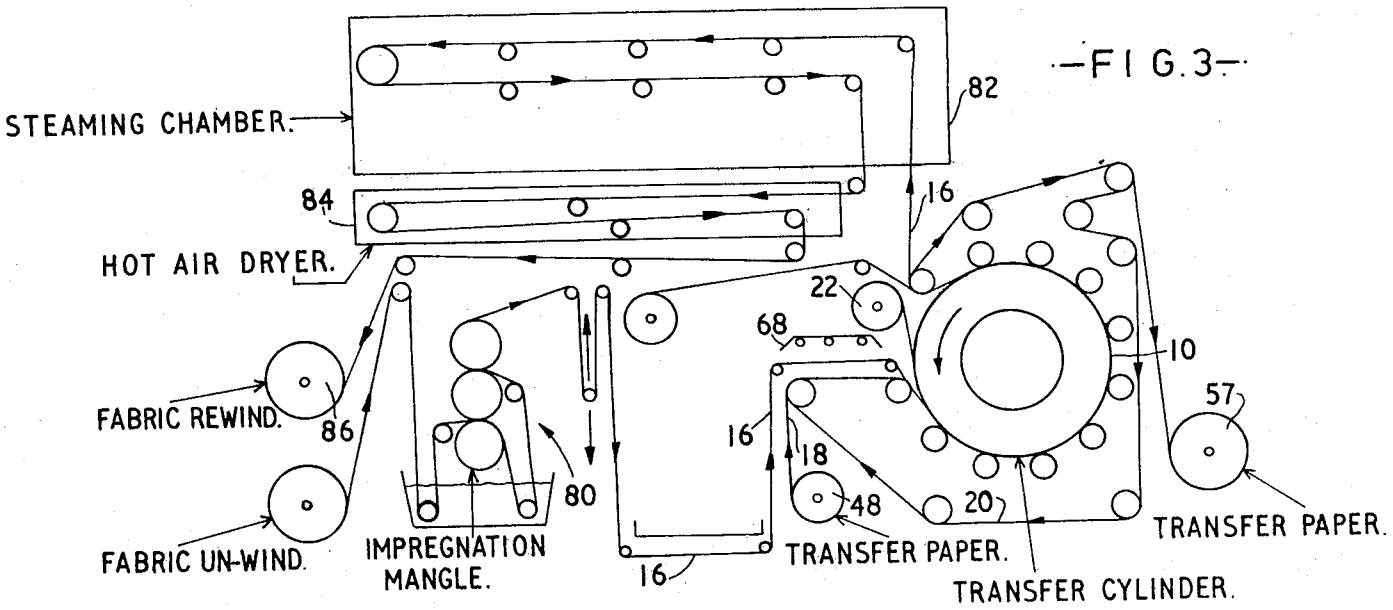
-FIG. 3-

WET TRANSFER PRINTING PROCESS AND APPARATUS

The present invention relates to wet transfer printing and is particularly concerned with a machine for the continuous wet transfer printing of fabrics and the process of wet transfer printing effected thereby.

A wet transfer printing process for fabrics is known which comprises the following three stages.

1. Printing the required design on a selected grade of paper, using specially chosen dyes dispersed in a suitable paper printing medium.

2. Impregnating the fabric (nylon, wool, acrylic or the like) with an aqueous solution which may, for example, contain a dye fixation catalyst and a thickener, the latter to act as a dye migration controller and film-stabiliser.

3. Bringing the printed paper and the impregnated fabric into close conformity, by applying pressure, and maintaining this conformity under pressure for a period which may vary from a few seconds to several minutes, while maintaining the paper and fabric in a moist condition at a temperature of at least 100° C. Under these circumstances, the dyes on the printed paper are almost completely transferred to the fabric and, provided sufficient contact time is allowed, are fixed in the same operation.

It is presently known for the aforegoing process to be carried out discontinuously using heated garment presses of the type used in the making up of garments. Usually, the fabrics to be printed are in the form of garment panels, or body blanks, stretched over plastics formers prior to transfer printing. After printing, the fabrics may be washed, rinsed and dried ready for making up.

One of the essential requirements of the satisfactory dye transferring operation is the need for the application of substantial pressure on the fabric/paper combination. Present indications are that the pressure required to achieve satisfactory dye transfer from paper to fabric in wet transfer printing is substantially higher than that required during normal vapour phase transfer printing and may be of the order of 5 p.s.i. or even higher.

The reason for this higher order of pressure being necessary for wet transfer printing is believed to be the need for establishing and maintaining a substantially continuous film of moisture between the paper containing the dyes and the fabric being printed. The mechanism of dye transfer from paper to fabric is one comprising initial solution of dye in the moisture film, followed by migration through the film to the fabric surface and finally the absorption and fixation of the dye to the fabric, all of which take place under the combined effects of moisture, temperature, pressure and time of contact. As most fabrics exhibit a somewhat irregular surface contour, some degree of pressure is necessary in order to flatten the fabric surface and urge it into close conformity with the transfer paper containing the dye. Such a degree of conformity is not necessary with vapour phase transfer printing, because the dye is volatilised from the transfer paper by means of a heated cylinder or hotplate, and the dye vapour is able to diffuse through any small air gap which may be separating the fabric and transfer paper. On the other hand, in a wet transfer process, the dye can only transfer via a film of moisture bridging any gap between the fabric and the transfer paper. Clearly, if such a bridging film was established and maintained over the whole area of contact of fabric and paper, then dye transfer would be very much faster and more complete than if such a film merely existed between the paper and the "peaks" of the fabric contour. In the latter case, there is evidence that such dye as does transfer to the "peaks" tends to remain on the "peaks", thus giving rise to a speckled printed effect, in addition to a slow rate of dye transfer.

Having established the reasons for the substantially higher pressure requirement in a wet transfer printing process, it should be pointed out that such required pressures are easily attainable in the discontinuous garment type of press mentioned above. However, difficulties arise in providing such high pressures utilising presently available machinery if it is desired to make the process continuous, i.e. to wet transfer print onto a continuously moving fabric web.

So-called blanket calenders are presently known for other types of transfer printing process, such as vapour phase transfer printing, where only relatively low pressures are required. Such machines in their present form usually have a heated cylinder around which the transfer paper and fabric webs are continuously passed one on top of the other, the two webs being held together and in contact with the cylinder by means of a continuous belt, known as a "blanket", which is guided around a major portion of the periphery of the cylinder with the two webs therebetween. The cylinder is usually of a size to permit running speeds of from 6–15 yards/minute with the order of contact time necessary with vapour phase transfer printing (20–30 seconds). Such machines have two main disadvantages when considered for use in a wet transfer printing process.

Firstly, the conventional blanket is usually of a needle punched Nomex fibre construction, designed to withstand temperatures of up to 220° C or higher. This is not suitable for wet transfer printing because, being porous, it would allow the wet fabric to dry out during its passage round the heated cylinder. This would inhibit dye transfer and also the subsequent dye fixation, both of which call for a high moisture retention in the fabric during the whole of the transfer operation, as described above.

Secondly, the maximum pressure capable of being applied to the paper/fabric combination by tensioning the blanket is too low for satisfactory wet transfer printing.

It is one object of the present invention to develop the aforementioned known blanket calender type of machine such as to render it capable of satisfactorily effecting wet transfer printing.

In accordance with one aspect of the present invention, there is provided a wet transfer printing machine comprising impregnation mangle means for impregnating a fabric web with an aqueous solution, a rotatable cylinder, means for heating the cylinder to a predetermined temperature, an endless belt of water impervious material which is guided around a major portion of the periphery of the cylinder, means for tensioning said endless belt, guide means for guiding a transfer web and said wet, impregnated fabric web around the cylinder beneath said belt, with one web on top of the other, whereby the belt tension subjects the transfer/fabric web combination to a first pressure, and a plurality of pressure applicator means mounted radially outwardly of the cylinder at circumferentially spaced locations around the cylinder, each pressure applicator means including a pressure applicator member and actuator means for displacing said pressure applicator member towards the cylinder, said pressure applicator means being arranged such as to subject the transfer/fabric web combination to additional pressures when the web combination passes between said circumferentially spaced pressure applicator means and said cylinder, the pressure applicator means being adapted such that the individual magnitudes of said additional pressures applied thereby to said transfer/fabric web combination are of progressively incresing level, considered in the direction of passage of said web combination around the cylinder.

Advantageously, each said pressure applicators means comprises a pressure roller whose rotational axes is parallel to that of the cylinder, and which are adapted to be driven and to be individually displaceable in a direction radially of the cylinder, the radial displacement of the pressure rollers being conveniently achieved by respective, individually controllable pneumatic or hydraulic cylinders or by other mechanical means.

The pressure applicator means can take other forms. For example, each applicator means can take the form of a shoe having a working surface shaped to conform to a portion of the periphery of the cylinder, each shoe being individually displaceable by means of a hydraulic or pneumatic cylinder in a direction radially of the cylinder. Said working surface, which contacts the outer surface of the blanket in operation, is advantageously of polytetrafluoroethylene or other low friction material.

A further pressure applicator means can take the form of an adjustably inflatable bag enveloping at least a part of the periphery of the cylinder with the paper/-fabric web combination passing therebetween. By increasing the pressure in the bag, the pressure applied by the bag to the web combination can be increased.

In accordance with a second aspect of the present invention, a process for wet transfer printing comprises with impregnating a fabric web with an aqueous solution by passing the web through an impregnation mangle, passing the wet impregnated fabric web together with a transfer web, with one web on top of the other, between the periphery of a heated cylinder and a moving, endless, water impervious belt which is guided around a major portion of the periphery of the cylinder and tensioned so as to subject the webs to a first pressure and, during passage of the webs around the cylinder, successively passing the webs beneath a plurality of pressure applicator means mounted radially outwardly of the cylinder at circumferentially spaced locations around the cylinder whereby to periodically subject the webs to additional pressures when the webs pass between said circumferentially spaced pressure applicator means and said cylinder, the individual magnitudes of said additional pressures applied by the pressure applicator means to the webs being of progressively increasing level, considered in the direction of passage of the webs around the cylinder, and the combined effect of the first and additional pressures being sufficient to flatten the fabric web whereby the transfer and fabric webs are placed in intimate contact.

In the aforegoing process, said additional pressures produced for example by means of the pressure rollers or pressure shoes, are applied to the wet fabric/transfer web combination already held under the tensioned, water impervious belt (blanket), a significant improvement in dye transfer is achieved, compared with a similar web combination held under blanket pressure alone.

It has been discovered that the successively encountered additional pressures, applied by said plurality of pressure applicator means, can result in further improvements in dye transfer characteristics. In particular, a multiplicity of such applicator means, allows a graded pressure system to be utilised. For example, such a pressure system may be arranged to commence with a relatively low additional pressure, increasing in stages to relatively high pressures, as required. This system is in effect a method of controlling the rate of release of dye from the transfer web, so as not to release dye faster than the particular fabric in question can absorb it, which would lead to colour bleeding or "flushing". In other words, in the early stages of the transfer operation, before the wet fabric has attained its maximum temperature, the applicator pressures can be comparatively low but as the fabric heats up and becomes more receptive to dye, so the subsequent pressures are increased accordingly. Indeed, with certain fabrics it has been observed that improved results can be obtained if, after the introduction of the fabric/transfer web combination into the blanket pressure system, there is a short delay before the first additional pressure is applied. This ensures that the fabric temperature is sufficiently high to allow it to absorb dye, before the rate of dye release from the transfer web is increased by the first of the pressures.

As will be understood from the above discussion, the range and magnitude of said additional pressures applicable by means of a multiplicity of pressure applicators can be varied between wide limits, to suit a wide range of fabric types. However, at no time during the transfer operation should the combined pressure exerted by the first and additional pressures exceed that of the mangle used to impregnate the fabric prior to transfer printing. If this was the case, then there would be a serious risk of the impregnating solution being expressed during the passage of the wet fabric beneath such pressure applicators, which would lead to severe pattern smudging and also contamination of the machinery.

A possible explanation as to why the present process is successful is believed to lie in the fact that while a comparatively high pressure is required to bring about the necessary degree of fabric deformation to achieve good surface conformity with the transfer web, a relatively low pressure is sufficient to maintain the fabric in its deformed state. Thus, provided that the initial fabric deformation can be produced by the combined effect of the first and second pressures, then the recovery forces operating within the deformed fabric, which are comparatively weak, can be easily overcome by the relatively low, further pressure afforded by the blanket tension.

The invention is described further hereinafter, by way of example, with reference to the accompanying drawings, in which:

FIG. 3 is a diagrammatic illustration of a complete wet transfer printing process utilising the machine of FIG. 1.

Figure 1:
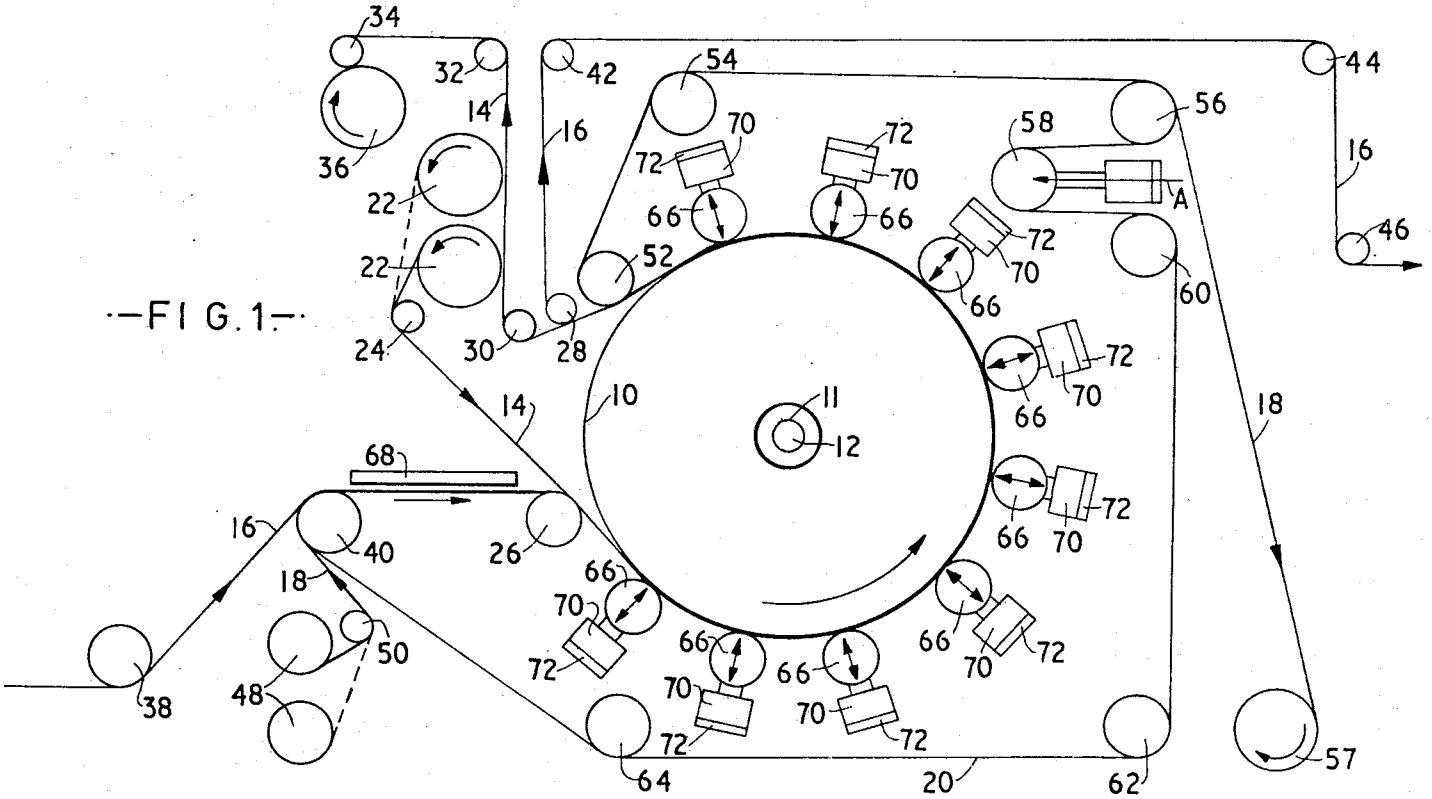
FIG. 1 is a diagrammatic illustration of one embodiment of a wet transfer printing machine constructed in accordance with the present invention.

The machine illustrated in FIG. 1 comprises a cylinder or drum 10 which is journalled for free rotation about a central longitudinal axis 12. The cylinder 10 is arranged to be heated to an operating temperature of about 110° C–125° C, for example by steam at a pressure of approximately 10–30 p.s.i. supplied to the interior of the cylinder 10 via a central bore 11.

The transfer process involves passing a first web 14 of backing paper (if required) around the cylinder 10 in contact with a second, wet fabric web 16 to which the transfer is to be applied, a third web 18, consisting of the transfer paper bearing the transfer to be printed, being passed around the cylinder in intimate contact with the second, fabric web 16. A fourth web, comprising an endless blanket 20, passes around the outside of the three webs 14, 16, 18 to urge these webs against the cylinder 10. Preferably the web 20 is made of impervious, fabric-reinforced rubber having a thickness in the range ⅛ to ⅜ inch.

As illustrated, the inner web 14 of backing paper (which may not always be required) is stored on rolls 22 and is guided onto the cylinder 10 by way of guide rollers 24 and 26. After passing around the majority of the periphery of the cylinder 10, the inner web 14 leaves the cylinder 10 via fuurther guide rollers 28, 30, 32 and 34 and is taken up on a roll 36.

The wet fabric web 16, arriving from a previous stage in which it is impregnated with the aforementioned dye fixation catalyst and thickener (see FIG. 3), passes over further guide rollers 38, 40 over the previously mentioned guide roller 26, around the cylinder 10 and is removed via the roller 28 and further rollers 42, 44, 46 to an assembly point in readiness for the next stage of processing (see FIG. 3).

The transfer paper web 18 is guided onto the cylinder 10 from storage rolls 48 via a guide roller 50 and the previously mentioned rollers 40 and 26 and leaves the cylinder via further rollers 52, 54 and 56, primarily provided for carrying the endless blanket 20, to be taken up by a roll 57. In addition to the rollers 52, 54 and 56, the blanket is guided around the periphery of the cylinder by further guide rollers 58, 60, 62 and 64 and the previously mentioned rollers 40 and 26, the roller 58 being displaceable in the direction of the arrow A by means of, for example, a hydraulic or pneumatic cylinder for adjusting the blanket tension.

As illustrated in FIG. 1, the rollers 26 and 52 are spaced slightly from the surface of the cylinder 10 whereby the webs 14, 16, 18 are not nipped and hence not subjected to radial pressure by the rollers 26, 52 when passing between these rollers 26, 52 and the cylinder 10.

In order to provide the necessary pressure on the three webs 14, 16 and 18 to effect transfer of the dye to the fabric web when the webs are being passed around the heated cylinder 10, a plurality of radially displaceable, driven pressure rollers 66 are located behind the blanket 20 at different points around the periphery of the cylinder 10. The pressure rollers 66 are rotatable about their longitudinal axes by a mechanical drive (not shown) such as a crown wheel and pinions or by a chain. The pressure rollers 66 are adapted to be individually actuable, for example by means of respective air cylinders illustrated diagrammatically at 70, the actual pressure applied by each roller to the web sandwich between that roller 66 and the cylinder 10 being variable by adjusting the air pressures applied to the individual air cylinders by means of respective control valves illustrated diagrammatically at 72.

By virtue of the pressure rollers 66, a graded pressure distribution can be set up whereby, as the webs progress around the cylinder, the webs are subjected to a series of gradually increasing pressure transients due to their passage past the constantly actuated pressure rollers. Thus, for example, the first roller 66 encountered could apply a pressure $P_1$. Downstream of the first roller 66 (between the first and second rollers 66) the webs would only be subjected to the pressure attributable to the blanket tension. The second roller 66 could then apply a pressure $P_2$ which is larger than $P_1$. Subsequent rollers 66 would apply respective pressures $P_3$, $P_4 \ldots$ $P_n$ with:

$$P_n > P_{n-1} > P_{n-2} \ldots$$

Figure 2:
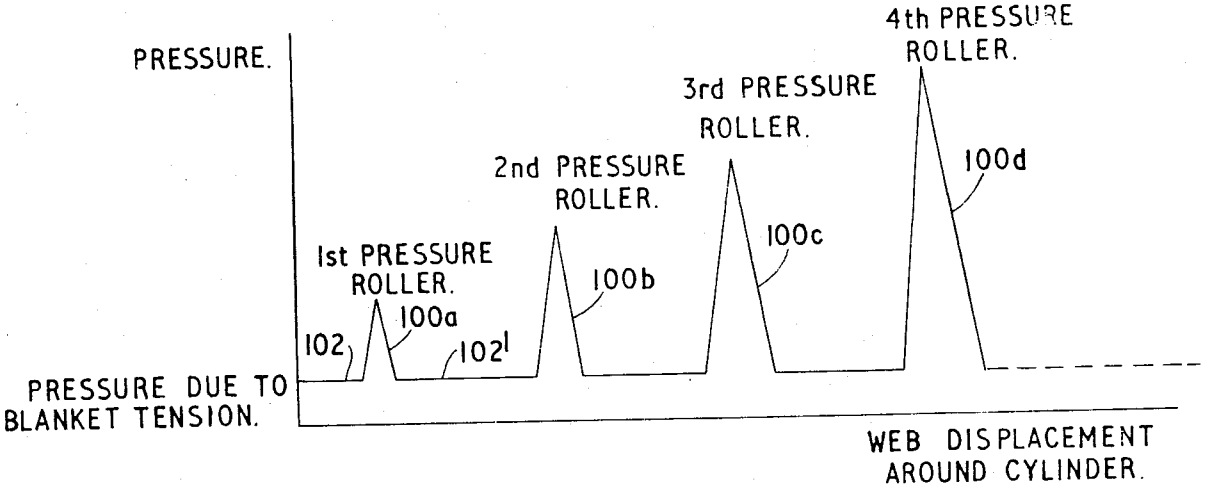
FIG. 2 is a graph of pressure against web displacement around the heated cylinder.

This situation is illustrated diagrammatically in the graph of FIG. 2 wherein a plurality of pressure pulses 100*a*, 100*b*, 100*c*, 100*d* of progressively increasing magnitude occur, ocrresponding to the first four pressure rollers 66. The reference numeral 102 indicates the pressure due to the blanket tension alone.

Other pressure distributions could be utilised depending on the nature of the fabric and the characteristics of the dye.

FIG. 3 illustrates the complete system in which the machine of FIG. 1 is employed. The fabric web 16, before it reaches the cylinder 10, is passed through an impregnation mangle 80 where it is impregnated with an aqueous solution which may, for example, contain a dye fixation catalyst and a thickener. After leaving the cylinder 10, the fabric web 16 may be passed through a steaming chamber 82 and a hot air drier 84 before being collected on a rewind roll 86. In the embodiment illustrated, an infra-red pre-heater 68 is provided for preheating the webs 16 and 18 before entry onto the cylinder 10.

Each pressure roller 66 can alternatively take the form of a shoe (not shown) having a working surface shaped to conform to a portion of the periphery of the cylinder 10, each shoe being individually displaceable by means of a hydraulic or pneumatic cylinder, similar to the cylinders 70, in a direction radially of the cylinder 10. Said working surface, which contacts the outer surface of the blanket in operation, is advantageously of polytetrafluoroethylene or other low friction material.

In a further embodiment, the pressure rollers 66 can be replaced by an adjustably inflatable bag enveloping at least a part of the periphery of the cylinder 10 with the paper/fabric web combination passing therebetween. Increasing the pressure in the bag can be arranged to increase the pressure applied by the bag to the web combination.

The invention is further illustrated by, but not limited to, the following examples.

The machine used to carry out the following examples was constructed substantially as described above with reference to the drawings and had the following specifications.

The cyliner 10 had a diameter of 24 inches and a face width of 25 inches and was fitted with a 24 inch wide water impervious blanket 20 of fabric reinformed rubber construction, which was guided round approximately 300° of the cylinder circumference by means of the rollers (52, 54, 56, 58, 60, 62, 64, 40 and 26. The tensioning roller 58 was actuable by means of two 4 inch diameter pneumatic cylinders with an operating pressure of up 100 psi. The machine was fitted with nine 3 inch diameter pressure rollers 66 evenly spaced around the blanket covered portion of the surface of the cylinder 10. Each pressure roller was actuable by means of two 2 inch pneumatic cylinders with an operating pressure of up to 100 psi.

The speed of the machine was variable between zero and 6 yards/minute and the temperature of the steam heated cylinder 10 was controlled by means of a pressure regulating valve (not shown) on the steam supply to the cylinder.

EXAMPLE 1

A scoured double pique weft knit nylon 6, 6 stretch furnishing fabric, of approximately 270 grammes/-square meter was impregnated with an aqueous solution containing 50 gm/liter of a product sold under the trade name "Fastran Powder" by Joseph Dawson (Holdings) Limited, Selkirk, Scotland. The impregnated fabric was mangled so as to retain an amount of liquor equivalent to 150% by weight of the dry fabric weight. The wet fabric 16 was then run into the machine described above, sandwiched between a backing paper 14 and a transfer printing paper 18 which had been printed with a multicoloured design, using inks containing fibre reactive dyes sold under the trade name "Lanasol" by Ciba-Geigy Limited, Basle, Switzerland.

The stem heated cylinder 10 was adjusted to 115° C, the pneumatic cylinders applying pressure to the tensioning roller 58 were operating at 60 psi and the running speed was 4 yards/minute. The pressure rollers 66 were adjusted by means of the actuating cylinders 70 such that Nos. 1 to 3 were operating at 40 psi, No. 4 to 6 at 60 psi and No. 7 to 9 at 80 psi, numbering from fabric inlet to fabric exit.

The wet fabric emerged from the machine with a clear, sharp multicoloured design printed on it and required only washing and drying as after-treatment. Analysis of the spent-transfer printing paper 18 indicated a dye transfer from paper to fabric of 81%.

The same fabric processed under identical conditions, except that zero pressure was applied by the pressure rollers 66, yield a print with a speckled, uneven appearance and analysis of the spent transfer printing paper 18 indicated a dye transfer from paper to fabric of only 22%.

EXAMPLE 2

A scoured double jersey fabric of weight approximately 407 grammes/square meter and comprising acrylic fibres sold under the trade name "Courtelle", was impregnated with the same solution as that used in Example 1 and mangled as in Example 1. The wet fabric was then run into the machine described above, sandwiched between a backing paper 14 and a transfer printing paper 18 which had been printed with a multicoloured design, using inks containing cationic dyes sold under the trade name "Maxilon" by Ciba-Geigy Limited.

The machine conditions were similar to those in Example 1 except that the pressure rollers were adjusted such that Nos. 1 to 4 were operating at zero pressure, Nos. 5 to 6 were at 15 psi and Nos. 7 to 9 at 20 psi.

The wet fabric emerged from the machine with a clear, sharp multicoloured design and again required only washing and drying.

The same fabric processed under identical conditions except that zero pressure was applied by the pressure rollers 66 yielded an uneven speckled print and examination of the spent transfer printing paper indicated much lower dye transfer from paper to fabric than when treated as described above.

EXAMPLE 3

A bleached and mercerised 100% cotton plain fabric of 80 × 80 warp and weft threads per inch, and of 30's English cotton count, was impregnated in an aqueous solution containing 20 gm/liter of sodium bicarbonate and afterwards mangled so as to retain an amount of liquor equivalent to 75% by weight of the dry weight of the fabric. The wet fabric was then run into the machine described above, sandwiched between a backing paper 14 and a transfer printing paper 18 which had been printed with a multicoloured design, using inks containing fibre reactive dyes sold under the trade name "Procion" by I.C.I. Limited.

The temperature of the steam heated cylinder 10 was adjusted to 107° C, the pneumatic cylinders applying pressure to the tensioning roller 58 were operated at 80 psi and the running speed was 4 yards/minute. The pressure rollers 66 were adjusted so that all nine were operating at a pressure of 90 psi.

The wet fabric emerged from the machine with a clear, sharp multicoloured design printed on it. The wet fabric was then given a short steaming treatment to complete the dye fixation and then washed and dried.

A further sample of the same fabric processed under identical conditions, except that zero pressure was applied by the pressure rollers 66, exhibited a very poor printed appearance and very much lower dye transfer from paper to fabric.

I claim:

1. A process for wet transfer printing comprising impregnating a fabric web with an aqueous solution by passing the web through an impregnation mangle, passing the wet impregnated fabric web together with a transfer web, with one web on top of the other, between the periphery of a heated cylinder and a moving, endless, water impervious belt which is guided around a major portion of the periphery of the cylinder and tensioned so as to subject the webs to a first pressure and, during passage of the webs around the cylinder, successively passing the webs beneath a plurality of pressure applicator means mounted radially outwardly of the cylinder at circumferentially spaced locations around the cylinder whereby to periodically subject the webs to additional pressures when the webs pass between said circumferentially spaced pressure applicator means and said cylinder, the individual magnitudes of said additional pressures applied by the pressure applicator means to the webs being of progressively increasing level, considered in the direction of passage of the webs around the cylinder, and the combined effect of the first and additional pressures being sufficient to flatten the fabric web whereby the transfer and fabric webs are placed in intimate contact and also being sufficient to form a substantially continuous aqueous film between the two webs.

2. A wet transfer printing machine comprising impregnation mangle means for impregnating a fabric web with an aqueous solution, a rotatable cylinder, means for heating the cylinder to a predetermined temperature, an endless belt of water impervious material which is guided around a major portion of the periphery of the cylinder, means for tensioning said endless belt, guide means for guiding a transfer web and said wet, impregnated fabric web around the cylinder beneath said belt, with one web on top of the other, whereby the belt tension subjects the transfer/fabric web combination to a first pressure, and a plurality of pressure applicator means mounted radially outwardly of the cylinder at circumferentially spaced locations around the cylinder, each pressure applicator means including a pressure applicator member and actuator means for displacing said pressure applicator member towards the cylinder, said pressure applicator means being actuated to subject the transfer/fabric web combination to additional pressures when the web combination passes between said circumferentially spaced pressure applicator means and said cylinder, the actuator means being adjusted such that the individual magnitudes of said additional pressures applied by said pressure applicator means to said transfer/fabric web combination are of progressively increasing level, considered in the direction of passage of said web combination around the cylinder the combined effect of the first and additional pressures being sufficient to flatten the fabric web whereby the transfer and fabric webs are placed in intimate contact and also being sufficient to form a substantially continuous aqueous film between the two webs.

3. A wet transfer printing machine comprising impregnation mangle means for impregnating a fabric web with an aqueous solution, a rotatable cylinder, means for heating the cylinder to a predetermined temperature, an endless belt of water impervious material which is guided around a major portion of the periphery of the cylinder, means for tensioning said endless belt, guide means for guiding a transfer web and said wet, impregnated fabric web around the cylinder beneath said belt, with one web on top of the other, whereby the belt tension subjects the transfer/fabric web combination to a first pressure, a plurality of pressure rollers mounted radially outwardly of the cylinder at circumferentially spaced locations around the cylinder and with their rotational axes parallel to that of the cylinder, and a plurality of individually controllable power cylinders connected to the pressure rollers for urging said pressure rollers towards the cylinder to subject the transfer/fabric web combination to additional pressures when the web combination passes between said rollers and said cylinder, the pressure rollers and their associated power cylinders being adjusted such that the individual magnitudes of said additional pressures applied therey to said transfer/fabric web combination are of progressively increasing level, considered in the direction of passage of said web combination around the cylinder, the combined effect of the first and additional pressures being sufficient to flatten the fabric web whereby the transfer and fabric webs are placed in intimate contact and also being sufficient to form a substantially continuous aqueous film between the two webs.

4. A wet transfer printing machine comprising impregnation mangle means for impregnating a fabric web with an aqueous solution, a rotatable cylinder, means for heating the cylinder to a predetermined temperature, an endless belt of water impervious material which is guided around a major portion of the periphery of the cylinder, means for tensioning said endless belt, guide means for guiding a transfer web and said wet, impregnated fabric web around the cylinder beneath said belt with one web on top of the other whereby the belt tension subjects the transfer/fabric web combination to a first pressure, said guide means including a plurality of guide rollers whose rotational axes are parallel to the axis of the cylinder, the first and last of said rollers encountered by the transfer/fabric web combination in passing around the cylinder being spaced from the cylinder sufficiently to prevent the web combination being nipped between said first and last encountered guide rollers and the cylinder, and a plurality of pressure applicator means mounted radially outwardly of the cylinder at circumferentially spaced locations around the cylinder, each pressure applicator means including a pressure applicator member and actuator means for displacing said pressure applicator member towards the cylinder, said pressure applicator means being actuated to subject the transfer/fabric web combination to additional pressures when the web combination passes between said circumferentially spaced pressure applicator means and said cylinder, the actuator means being adjusted such that the individual magnitudes of said additional pressures applied by said pressure applicator means to said transfer/fabric web combination are of progressively increasing level, considered in the direction of passage of said web combination around the cylinder, the combined effect of the first and additional pressures being sufficient to flatten the fabric web whereby the transfer and fabric webs are placed in intimate contact and also being sufficient to form a substantially continuous aqueous film between the two webs.

* * * * *